United States Patent [19]

Eubanks et al.

[11] 4,172,521

[45] Oct. 30, 1979

[54] DEVICE FOR HOLDING AND ORGANIZING STRANDS OF YARN

[76] Inventors: Ann S. Eubanks, Flossie Inc., 3837 Hixson Pike; Celeste M. Steinkraus, 204 E. Lakeshore Ter., both of Chattanooga, Tenn. 37415

[21] Appl. No.: 879,526

[22] Filed: Feb. 21, 1978

[51] Int. Cl.[2] ..... B65H 49/30

[52] U.S. Cl. ..... 206/388; 223/106

[58] Field of Search ..... 223/106; 206/388; 242/85.1; 28/299; 66/1 A; D15/66

[56] References Cited

U.S. PATENT DOCUMENTS

| | | | |
|---|---|---|---|
| 534,390 | 2/1895 | Fraley | 206/388 |
| 765,720 | 7/1904 | Thomas | 206/388 |
| 792,563 | 6/1905 | Turner | 206/388 |
| 1,388,561 | 8/1921 | Grote | 206/388 |
| 2,582,319 | 1/1952 | Ellis | 66/1 A |

FOREIGN PATENT DOCUMENTS

| | | | |
|---|---|---|---|
| 508625 | 2/1952 | Belgium | 206/388 |

*Primary Examiner*—Louis Rimrodt
*Attorney, Agent, or Firm*—Dowell & Dowell

[57] ABSTRACT

Apparatus including a substantially flat teardrop shaped holder with an opening at the broad end through which lengths of yarn may be looped, an aperture at the other end for suspending the device from a collection device, and a sleeve holder intermediate the two ends for receiving identification indicia. The shape of the holder is particularly advantageous when a plurality of holders are placed on the same collection device.

1 Claim, 5 Drawing Figures

DEVICE FOR HOLDING AND ORGANIZING STRANDS OF YARN

BACKGROUND OF THE INVENTION

1. Field of the Invention

This invention relates generally to apparatus for holding thread, yarn and the like and relates particularly to a device for organizing and holding in position for convenient examination and access a multiplicity of skeins of yarn, or the like, in order that the user may store in a manner for expeditious selection and retrieval of a large number of skeins, or lengths of thread and yarn, which may be the same color or may differ in color and color gradations.

2. Description of the Prior Art

Various devices including packages, cards and bobbins have been known heretofore which are provided for the purpose of wrapping lengths of yarn and thread thereon in order that the same may be stored in an organized fashion and retrieved as desired.

Thus, in the patent to Quinn U.S. Pat. No. 674,307, a book is disclosed having pages with apertures through which lengths of yarn may be placed and held for use.

Grote, U.S. Pat. No. 1,388,561, discloses a display card having a tongue adjacent one end around which a plurality of strands may be looped and having other tongues spaced therefrom for confining the ends of the strands.

Gomberg, U.S. Pat. No. 2,371,756, discloses a yarn bobbin of sheet material around which yarn may be wrapped.

Lobl, U.S. Pat. No. 2,422,358, discloses a yarn bobbin of sheet material shaped like a dumbbell and having slits at each end for receiving the ends of yarn which are wrapped around the body of the bobbin.

York, U.S. Pat. No. 2,646,196, discloses a sheet member yarn holder having several tongues around which different skeins of yarn are placed.

SUMMARY OF THE INVENTION

The storage and retention for convenient examination and use of a multiplicity of yarns presents a problem which has not been adequately met heretofore. In fancy needlework such as embroidery the user ordinarily uses portions of several skeins of embroidery floss or yarn of different colors and may desire to store a large number of skeins, or lengths of yarn or thread. These may differ in both major and minor color variations and textures. Thus, it becomes desirable to be able to visually to examine the yarn and also the specific written identification indicia associated with each skein which facilitates selection of the desired strand.

The present invention includes a holder for each skein of yarn, the holder having provision for looping the skein thereon, for mounting identification indicia, such as the sleeve in which the skeins are normally sold, on the holder for identification purposes, and an aperture for mounting the holder on a rod or ring member. The configuration of the holders is such as to facilitate mounting a substantial number in closely confined relationship on a ring or other collection member without presenting undue problems of interference between the individual members. Thus, groups of skeins may be mounted on ring members and be readily identifiable and manipulatable in order that one or more strands may be located, selected and removed from a skein without disturbing the remainder.

DESCRIPTION OF THE PREFERRED EMBODIMENT

Figure 1:
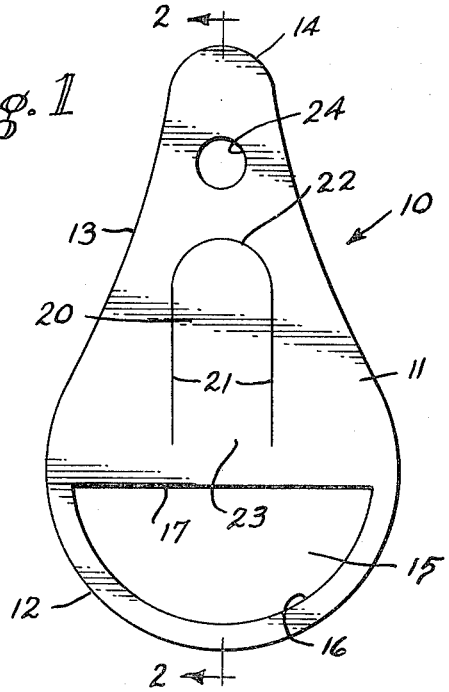
FIG. 1 is a plan view of a preferred embodiment of the invention.
Figure 2:
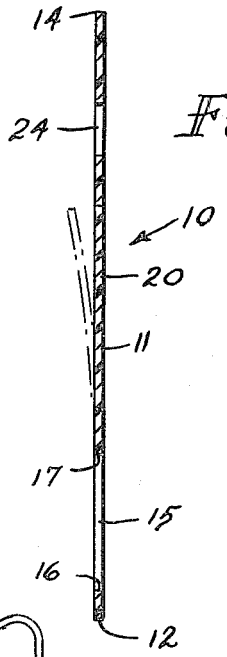
FIG. 2, a sectional view taken on the line 2—2 of FIG. 1.
Figure 4:
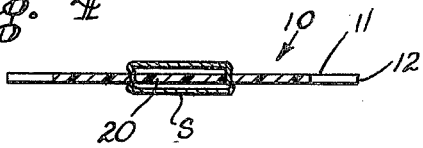
FIG. 4 is a sectional view taken on the line 4—4 of FIG. 3.
Figure 3:
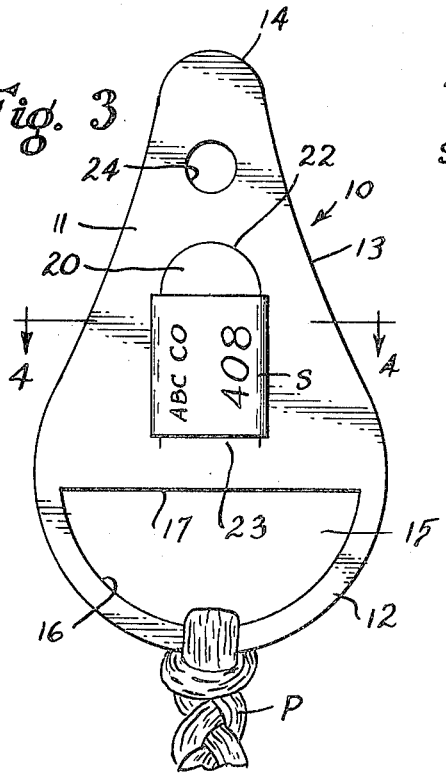
FIG. 3 is a plan view showing the invention in use.
Figure 5:
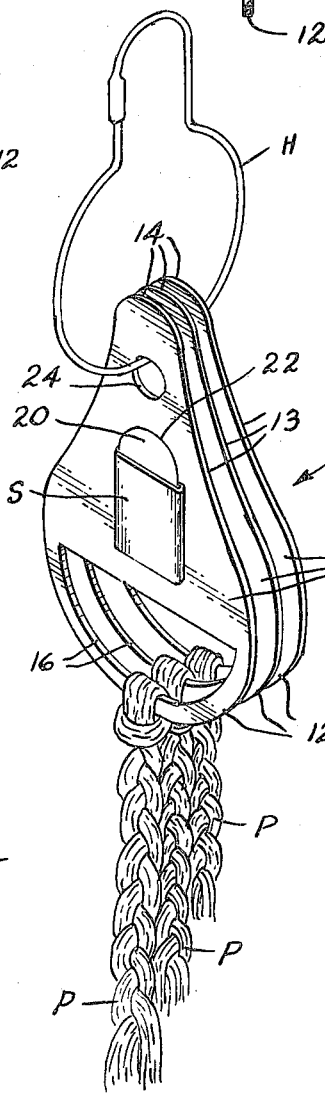
FIG. 5 is a perspective view of a representative assemblage of holders mounted on a ring.

With further reference to the drawings, the invention includes a holder 10 which consists essentially of a substantially flat, substantially teardrop shaped thin flexible body 11 of sheet material. The body has an enlarged substantially semicircular end portion 12, tapering sides 13 and a relatively small generally semicircular tip end portion 14 at the opposite end.

The end portion 12 of the body has a substantially semicircular aperture 15 with a curved part 16 spaced inwardly from and generally concentric with the rim of the end portion and a straight portion 17 extending substantially transversely across the larger end portion and between the sides thereof.

Intermediate the ends and the sides of the body 11, a tongue member 20 is provided generally axially thereof. The tongue member has substantially parallel sides 21 and a free end 22 which is adjacent to the smaller end of the body and with the tongue member being integrally connected at its base 23 adjacent to the straight portion of the aperture 15.

The tongue is preferably formed by punching or slitting the body in order that it may be displaced from the plane thereof or pressed back into the plane for the purpose of frictionally holding an identification member.

Adjacent to the smaller tip end portion 14, the body has an aperture 24 which is of a size for convenient reception of a ring or a rod supporting member as commonly employed.

In the use of the device it is contemplated that a skein of yarn or embroidery floss of indeterminate length will be subdivided into a plurality of pieces of equal length which are looped through the aperture 15 and then loosely braided to form a pigtail P, as indicated in the drawing. An indicia bearing sleeve S which normally encircles the central portion of the skein and identifies the particular color, dye lot, and the like is removed from the skein and is slipped over the tongue member 20 in order that the color or other quality of the yarn which is placed on the holder may be readily identified from the description on the sleeve. Even though the lengths of yarn are loosely braided, a single strand may be easily removed therefrom by separating it and pulling it from the loop portion where it hangs over the opening in the body.

The tongue member with the sleeve mounted thereon may be depressed into the plane of the body in order to assist in retention of the sleeve.

A substantial number of holders having full or partial skeins thereon may be mounted on a single ring or hook H as disclosed in the drawing. Due to the configuration of the holders and their flatness without any angular protrusions, the holders may be crowded together and manipulated for examination and removal of yarn therefrom without substantial difficulty. This would not be true if the holders had sharp corners or protrusions which would tend to engage each other or snag the yarn carried by adjacent holders if many of these were hung on a hook together. It is contemplated that a multiplicity of holders may be hung on a rod in order that the user may have convenient access to as large a number of skeins as desired.

What is claimed is:

1. Apparatus for holding and identifying a plurality of flexible strands of yarn, comprising, a thin substantially flat body of flexible thermoplastic material, said body having a large semicircular first end wall at one end and a small semicircular second end wall at the other end, said first and second end walls being connected by tapered side walls so that said body has a generally teardrop configuration, said one end having a first aperture spaced inwardly from said large semicircular wall to receive a plurality of strands of yarn, said first aperture having a first portion defining an arcuate wall located generally concentric with said one end and a second portion defining a straight wall located generally normal to the longitudinal axis of said body and connecting opposite ends of said arcuate wall, said other end of said body having a second aperture of a size to receive a support member, a tongue cut between said first and second apertures and along the longitudinal axis of said body, said tongue having generally parallel sides and a free end, the base of said tongue being integrally connected to said body adjacent to said first aperture so that a portion of said tongue may be displaced out of the plane of said body, said tongue being of a size to removably receive an indicia bearing sleeve which identifies the strands of yarn, and said portion of said tongue being repositionable in the plane of said body to assist in frictionally retaining the sleeve.

* * * * *